United States Patent [19]

Stanish

[11] 4,216,875

[45] Aug. 12, 1980

[54] COMBINATION UTENSIL AND LID FOR PACKAGED COMESTIBLES

[76] Inventor: Walter F. Stanish, 118 Rochelle Ave., Philadelphia, Pa. 19128

[21] Appl. No.: 19,384

[22] Filed: Mar. 12, 1979

[51] Int. Cl.[2] ..... B65D 51/24

[52] U.S. Cl. ..... 220/212; 220/23; 229/1.5 C; D7/50; D7/138

[58] Field of Search ..... 229/1.5 C; 220/212, 220/23, 306, 355; 215/227, DIG. 5, 292; D7/50, 138

[56] References Cited

U.S. PATENT DOCUMENTS

| | | | |
|---|---|---|---|
| D. 212,548 | 10/1968 | Ganssle | D7/50 |
| D. 219,945 | 2/1971 | Saila | D7/138 |
| 1,184,366 | 5/1916 | Miller | 206/218 |
| 1,516,334 | 11/1924 | Clement | 229/1.5 C |
| 1,734,477 | 11/1929 | Fowle | 229/1.5 C |
| 2,695,115 | 11/1954 | Roop | 220/355 |
| 2,816,589 | 12/1957 | Tupper | 220/306 |
| 3,371,847 | 3/1968 | Stengle, Jr. | 215/292 X |
| 3,624,787 | 11/1971 | Newman | 220/212 |
| 4,036,398 | 7/1977 | Hoogvelt | 229/1.5 C X |

*Primary Examiner*—Allan N. Shoap

*Attorney, Agent, or Firm*—Caesar, Rivise, Bernstein & Cohen, Ltd.

[57] ABSTRACT

The combination of a utensil and a lid for closing the mouth of a container, such as used for merchandising comestibles. The lid includes a central portion and circular wall means disposed about the entire periphery of the central portion. The wall means is arranged to engage the mouth of the container to secure the lid thereon. The utensil is arranged to be releasably secured within the lid and is in the form of an elongated member which is slightly bowed in transverse cross section and includes an opposed pair of arcuate ends, each of which has substantially the same radius of curvature as that of the circular wall means. The maximum length of the utensil is approximately the inside diameter of the circular wall means to enable the utensil to be frictionally held between opposed portions of the wall means. There are various embodiments of the utensil, such as a spoon, a fork, a knife and a measuring spoon.

4 Claims, 15 Drawing Figures

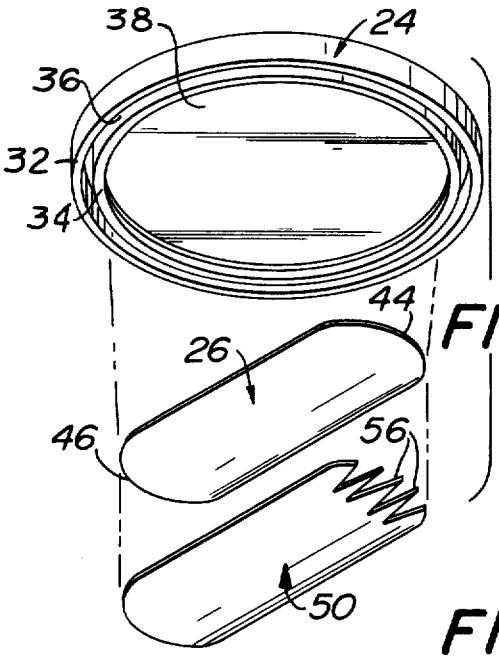
FIG. 6
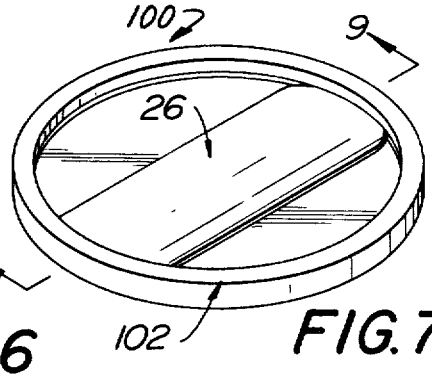
FIG. 7
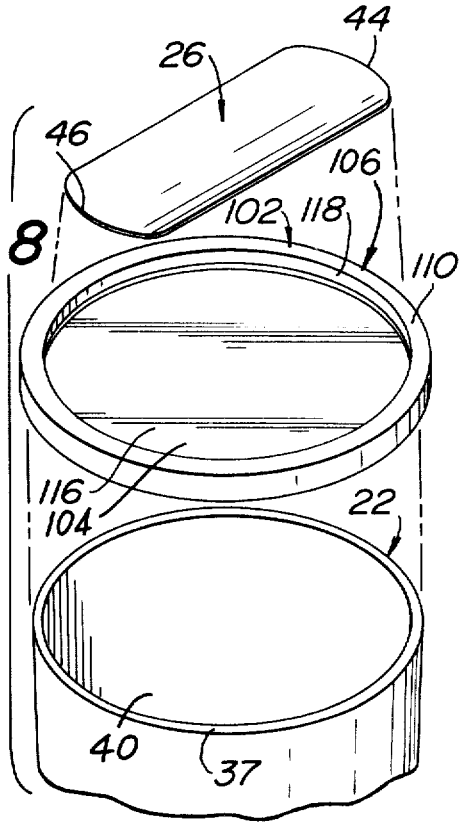
FIG. 8
FIG. 9
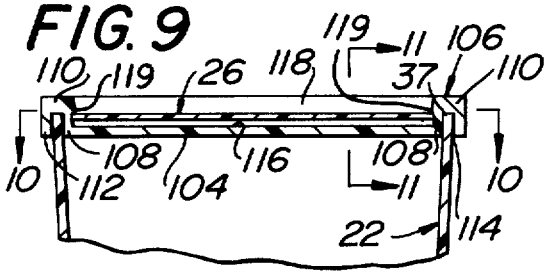
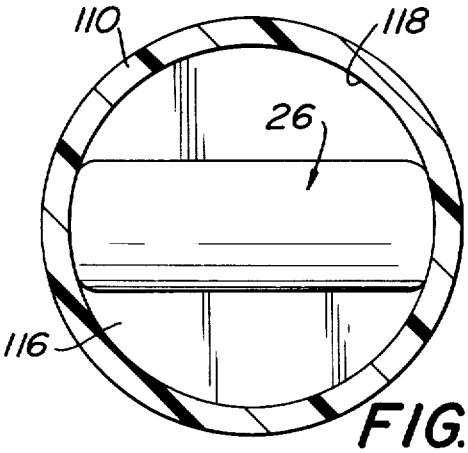
FIG. 10
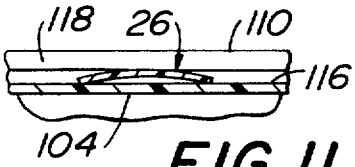
FIG. 11

FIG. 12
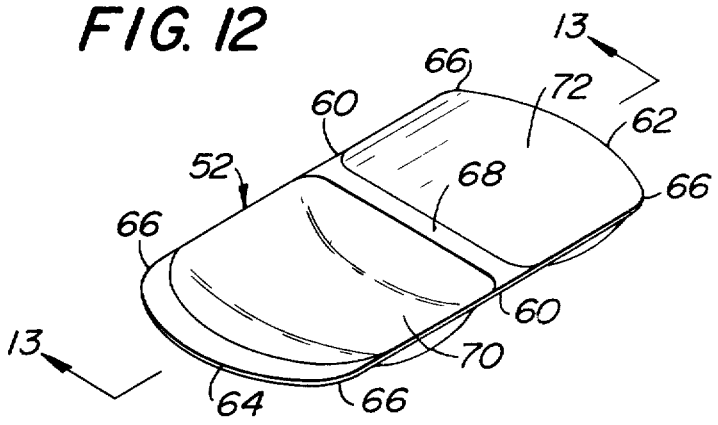
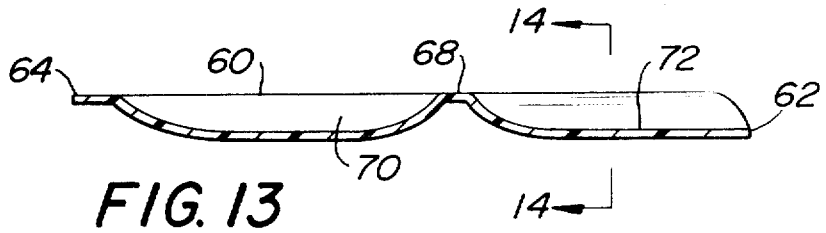
FIG. 13
FIG. 14
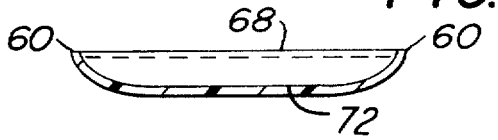
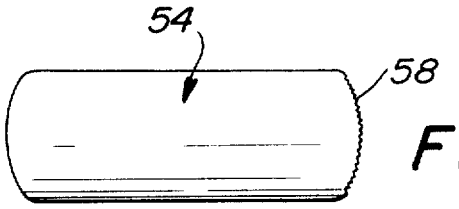
FIG. 15

COMBINATION UTENSIL AND LID FOR PACKAGED COMESTIBLES

This invention relates generally to container covers and, more particularly, to lids for comestible containers which include utensils combined therewith for use with said comestibles. As is known, various food products, e.g., yogurt, cold salads, puddings, prepared foods, etc., are packaged in individual portion containers for point-of-purchase usage. At present it is a usual practice for establishments selling such products or automated vending machines dispensing such products to supply plastic, cardboard or wooden utensils for use with such products. This has proved largely unacceptable.

Various lid devices have been disclosed in the patent literature which include means for forming a utensil for use with the comestible disposed in the container on which the lid is disposed. To that end, in U.S. Pat. No. 3,955,742 (Marshall et al) there is disclosed a container lid with a removable eating utensil. The lid comprises a generally flat central portion having a circular outer edge for securement to the upper lip of the product containing vessel. The utensil is formed as an integral portion of the lid but is separable therefrom by breaking it away from the portion of the lid along a continuous notch extending about the periphery of the utensil. While such a construction does enable one to produce a spoon, the construction entailed is relatively complex and expensive. Moreover, a substantial effort or manipulation may be required to break the spoon from the lid.

In U.S. Pat. No. 4,060,176 (Tobiasson) there is disclosed a container lid which is arranged to convert into a spoon. The lid comprises a disk-like central covering portion and having a rim channel extending thereabout for securement to the lip around the mouth of a container. The covering portion includes a score line defining a flap which is arranged to be bent out of a plane of the covering portion by breaking the covering along the score line. While the construction of this embodiment is relatively simple, the formation of the spoon renders the lid useless for re-use to close the container.

Other combined spoon and lids or covers are disclosed in U.S. Pat. Nos. 3,931,925 (Ruff), 3,954,178 (Mason, Jr.), 4,036,398 (Hoogevelt et al) and 4,095,716 (Meany).

Although various combination lids-utensils have been disclosed, as set forth above, the need presently exists for an effective, low-cost, simple and commercially viable device.

Accordingly, it is a general object of the instant invention to overcome the disadvantages of the prior art.

It is a further object of the invention to provide a combination lid and utensil which is adapted for use on various types of commercially available containers.

It is a further object of the instant invention to provide a combination lid and utensil which is simple in construction and low in cost.

It is a further object of the instant invention to provide a combination of lid and utensil which is compact.

It is still a further object of the instant invention to provide a combination lid and utensil and which is suitable to reclose a container after the lid has been removed and the utensil used.

These and other objects of the instant invention are achieved by providing a combination of a utensil and a lid for a container. The container is arranged for holding a product therein and has a mouth for access to the contents of the container. The mouth includes an arcuate rim disposed thereabout. The lid comprises a central portion and an arcuate wall projecting at an angle to the central portion. The wall encircles the periphery of the central portion and is arranged to cooperate with the rim of the container to secure the lid to the container. The utensil comprises an elongated member formed of a thin material and having a pair of opposed arcuate ends, with the maximum length of the utensil measured between the ends being slightly longer than the inside diameter of the wall, whereby the utensil is frictionally held between opposed portions of the wall when the lid is secured to the container, but can be readily removed therefrom for use on the contents of the container. The utensil has various embodiments such as a spoon, a knife, or fork and a measuring spoon.

Other objects and many of the attendant advantages of the instant invention will become better appreciated as the same becomes better understood by reference to the following detailed description when considered in connection with the accompanying drawing wherein:

FIG. 6 is an exploded perspective view showing the of the lid of FIG. 1 for holding a pair of different utensils;

FIG. 7 is a perspective view of an alternative embodiment of a combined lid-utensil;

FIG. 8 is an exploded perspective view, similar to that of FIG. 2, but showing the combined lid-utensil of FIG. 7;

FIG. 9 is a sectional view taken along line 9—9 of FIG. 7;

FIG. 10 is a sectional view taken along 10—10 of FIG. 9;

FIG. 11 is a partial sectional view taken along line 11—11 of FIG. 9;

FIG. 12 is a perspective view of another type of utensil;

FIG. 13 is an enlarged sectional view taken along line 13—13 of FIG. 12;

FIG. 14 is a sectional view taken along line 14—14 of FIG. 13; and

FIG. 15 is a top elevational view of yet another type of utensil.

Figure 1:
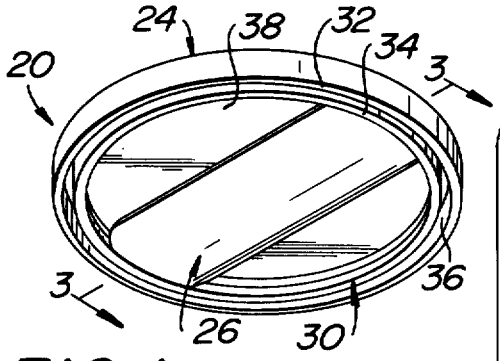
FIG. 1 is a perspective view showing the underside of a combined lid-utensil constructed in accordance with one embodiment of the instant invention.
Figure 2:
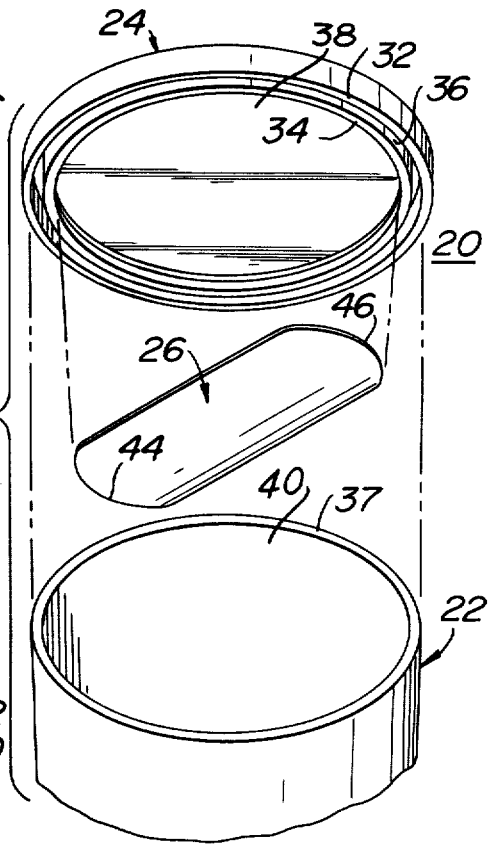
FIG. 2 is an exploded perspective view showing the combined lid-utensil of FIG. 1 oriented with respect to the mouth of a container for securement thereon.

Referring now to the various figures of the drawing wherein like reference numerals refer to like parts there is shown generally at 20 in FIG. 1 a combination lid and utensil for use on a container or vessel 22 (FIG. 2). The lid-utensil 20 basically comprises a cap or lid 24 and a utensil 26 releasably secured therein.

The lid 24 is in the form of a central disk portion which is planar and of generally of circular shape. The disk portion 28 includes circular wall 30 extending about the entire periphery thereof for securing the disk to the vessel and for holding the utensil 26 nested in place. The wall means 30 extends about the entire periphery of the disk and comprises a pair of downwardly extending walls. The outermost wall 32 is circular and extends about the outside periphery of the disk. The innermost wall 34 is also circular and is disposed concentrically within the outer wall. The space between the walls 32 and 34 is in the form of an annular recess 36 arranged for receipt of the lip or rim 37 of the mouth 40 of the container 22. The width of the annular recess, that is the space between the inner and outer walls, is approximately the same thickness as that of the rim or lip of the container so that when the cap is disposed over the container's mouth the rim is located within the recess and frictionally held therein as shown in FIG. 3.

It should be pointed out at this juncture that the combined lid-utensil 20 of this invention is adapted for use on various types of conventional containers, e.g., paper cups, plastics cups, tubs, etc., so long as the container includes an open mouth. Furthermore, the rim of the container mouth can be the same thickness as the container side wall, like shown in FIG. 2, or can be rolled, flanged or formed in any other manner, as is conventional.

Figure 3:
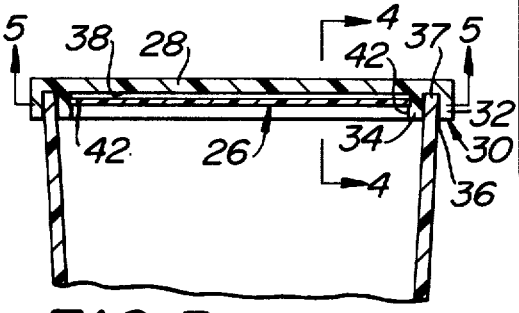
FIG. 3 is a vertical sectional view showing the combined lid-utensil of FIG. 1 secured in place on the mouth of a container.

As can be seen clearly in FIG. 3, the underside portion of the lid bounded by the inner wall 34 forms a central recess 38 which is adapted to receive and support a utensil constructed in accordance with this invention therein. The inner surface 42 on the inner wall 34 contiguous with the free edge thereof is in the form of an annular surface 42 which projects slightly inward radially from the remaining inner surface of the inner wall 34. Accordingly, the portion of the central recess contiguous with the underside surface of the lid has a slightly greater diameter than the diameter at the entrance to the recess, i.e., the portion of the recess between the opposed arcuate surfaces 42. In accordance with the embodiment shown in FIG. 3, the diameter of the central recess contiguous with the inner surface is approximately the same as the length of the utensil 26, whereas the inside diameter at the entrance to the recess is slightly smaller. Accordingly, when the utensil 26 is disposed within the recess 40, it is frictionally held in place against accidental removal by the presence of the inwardly projecting surfaces 42 at the entrance to the recess.

It should be pointed out at this juncture that the use of the arcuate projecting surfaces 34 on the inner wall is not the only means for accomplishing the function of retaining the utensil in place. To that end, the inner surface of the inner wall may be tapered conically or undercut or formed in any other manner so that the diameter of the recess portion contiguous with the underside of the lid is slightly greater than the entrance to the recess. In fact, while the use of the enlarged recess portion adjacent the underside of the lid is preferable, it is not crucial to the invention. In this regard, the retention of the utensil within the recess can be accomplished with a recess 40 whose inside diameter is constant for its full depth by merely utilizing a utensil whose length is slightly larger than the inside diameter of the inner wall so that when the utensil is disposed in place it flexes slightly and is thus frictionally held between the diametrically opposed surfaces of the inner wall.

As will be appreciated by those skilled in the art since the utensils of this invention are held in place between diametrically opposed surfaces of the inner wall, the utensils need not be disposed at any particular angular orientation with respect to the circumferene of the lid. This feature facilitates the assembly of the lid and utensil during manufacture.

Figure 4:
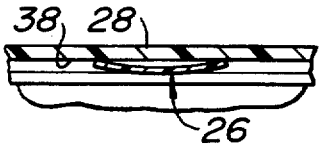
FIG. 4 is a partial sectional view taken along line 4—4 of FIG. 3.
Figure 5:
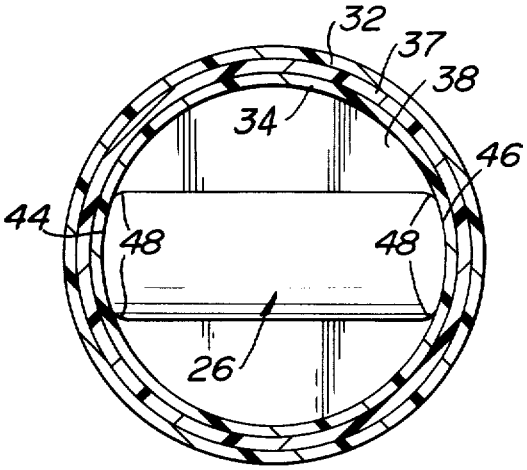
FIG. 5 is a sectional view taken along line 5—5 of FIG. 3.

The utensil 26 shown in FIGS. 1 through 3, as noted heretofore is one of several types, which will be described hereinafter. The utensil 26 is in the form of a spoon and basically comprises an elongated member whose longitudinal sides are straight and whose opposed ends 44 and 46 are arcuate. The radius of curvature of the arcuate ends 44 and 46 is preferably the same as the radius of curvature of the inner wall 34 of the lid as shown in FIG. 5. Each corner 48 of the utensil is rounded with the radius of curvature thereof being smaller than that of the arcuate ends. As can be seen in FIG. 4, the utensil 26 is bowed slightly when viewed in transverse cross section. This feature forms a scoop-like suitable for eating comestibles disposed within the container 22.

A fork utensil 50 is shown in FIG. 6, a measuring spoon utensil 52 is shown in FIG. 12 and a knife utensil 54 is shown in FIG. 15. Each of these utensils is arranged to be located and held within the recess 40 in lid 24 like spoon 26. In fact, as shown in FIG. 6, the lid 24 is suitable for holding plural utensils therein. To that end in FIG. 6, the lid is shown arranged to hold a spoon 26 and a fork 52 therein. In order to accommodate plural utensils within the lid 24, the utensils are preferably constructed so as to nest one within the other. Accordingly the fork 52 is constructed in an identical manner to the spoon 26, except that one of its arcuate ends includes a plurality of deep V-shaped notches to form plural tines 56.

The knife 54 shown in FIG. 15 is of identical construction to the spoon 26 except that one of its arcuate ends includes a plurality of shallow serrations 58. The shallow serrations at the end of the knife 54 serve as a cutting edge for cutting comestibles held within container 22.

The measuring spoon utensil 52 shown in FIGS. 12–14 basically comprises an elongated member having a pair of longitudinally extending straight sides 60 and a pair of arcuate ends 62 and 64. The radius of curvature of the ends 62 and 64 is preferably the same as the radius of curvature of the inner wall 34 of the lid. Each corner of the utensil 52 is rounded at 66. The length of the utensil 52 is preferably the same as the length of utensil 26, 50 and 54, described heretofore, so that it can be held securely within the lid 24 yet be readily releasable therefrom when desired. The utensil 52, like utensil 26, 50 and 54, is bowed in transverse cross-section. However, unlike utensil 26, 50 and 58 the measuring spoon 52 includes an intermediate barrier wall portion 68. The barrier wall portion 68 is planar. The end 64 of the utensil is in the form of a planar lip which is co-planar with the barrier wall 68 and with the top edges of the side 60. Accordingly, a bowl shaped depression 70 is formed between barrier 68, lip 64 and the upper edges of sidewall 60. The bowl 70 is dimensioned to provide a predetermined volummetric capacity, e.g., a teaspoon measure. The portion of the utensil 52 lying between the barrier wall 68 and the end 62, is denoted by the reference numeral 72 and forms the handle for holding the measuring spoon 52.

As will be appreciated by those skilled in the art the lids and utensils of this invention can be formed by various materials which are light weight, readily formable and inexpensive, e.g., paper, plastic, etc.

In FIG. 7 there is shown an alternative embodiment 100 of the combined lid-utensil of the instant invention.

To that end the combined lid-utensil 100 basically comprises a lid or cap 102 and a utensil 26 releasably supported therein. Like lid 24, lid 102 is adapted to hold one or more than one of the utensils 26, 50, 52 and 54 therein. In the interest of brevity only the securement of spoon 26 within lid 102 will be described hereinafter.

As can be seen in FIGS. 7 and 9 the lid 102 is in the form of a central disc 104 which is a planar member of generally circular shape and which includes circular wall means 106 extending about the entire periphery thereof. The wall means 106 includes an upwardly projecting circular inner wall 108, a radially extending flanged portion 110 and a downwardly projecting concentric circular outer wall 112. The space between the inner wall 108 and the outer wall 112 forms an annular recess 114 for receipt of the lip or rim 37 of the mouth 40 of the container 22. The width of the recess 114 is approximately the same as the thickness of the rim 37 of the container so that when the lid 102 is disposed over the container's mouth the rim is disposed within the annular recess 114 and frictionally held therein as shown in FIG. 9, in the same manner as described heretofore with reference to the lid 24.

The lid 102 is arranged to receive and hold the utensil 26 outside the container when the lid 102 is secured on the container, whereas the lid 24 is arranged to hold the utensil within the container when the lid 24 is secured to the container.

As shown clearly in FIG. 9 the topside portion 116 of the lid 106 bounded by the inner sidewall 108 forms a central recess 118 which is adapted to receive and support the utensil 26 therein in the same manner as described heretofore. To that end the inner surface on the inner wall 108 contiguous with the flanged intermediate portion 110 is in the form of an arcuate surface 119 which projects slightly inward radially from the remaining inner surface of the wall 108. Accordingly, the diameter of the recess 118 contiguous with the topside 116 of the lid 106 is slightly greater than the diameter of the entrance to the recess 118, that is the portion of the recess line between the arcuate surfaces of the inside wall 108. Moreover, the portion of the recess contiguous with the topside 116 of the lid is approximately the same size as the length of the utensil, whereas the inside diameter between the inward projecting surfaces 119 of the inside wall is slightly smaller than the length of the utensil. Accordingly when the utensil 26 is disposed within the recess 118 contiguous with the topside 116 it is frictionally held in place against accidental removal by the presence of the projecting surfaces 119.

It should be pointed out at this juncture that the use of the arcuate projecting surface 119 is not mandatory. Accordingly, like the lid 24, the lid 102 may utilize a circular inner wall which can be tapered conically or undercut so that the diameter of the recess portion immediately adjacent to the topside of the lid is slightly greater than the entrance to the recess. In fact while the use of the enlarged recess contiguous with the topside of the lid is preferable, it is not crucial to the invention. In this regard the utensil can be configured so that its length is slightly greater than the inside diameter of the inner wall when it is disposed in place in the recess 118 so that it flexes slightly and thus is frictionally held in place in the same manner as described with reference to the embodiment of the lid 24.

It should also be pointed out at this juncture that when the utensil is utilized in a lid, like lid 102, wherein it is held outside the container when the lid is secured in place, a circular cover sheet or insert can be disposed over the utensil within circular recess 118 to protect the utensil from contamination. In such a case the cover sheet may include tab means (not shown) for effecting its extraction from the recess 118 to expose the utensil for use.

It also must be pointed out at this juncture that the two embodiments of the lid shown herein, namely lids 24 and 102 do not represent all of the type of lids that can be made in accordance with the instant invention. In this regard various type lids, such as conventional polyethylene, polystyrene or wax paper lids which are commercially available today can be used, providing such lids include peripheral wall means having an inner wall forming a recess for receipt and frictional retainment of a utensil constructed in accordance with the instant invention.

As will be appreciated from the foregoing, the combined lid-utensil of the instant invention has considerable appeal to provide utensils for point-of-purchase usage of packaged combestibles. With this invention the utensil is part of the comestible package, readily available for immediate and convenient use by the consumer. Moreover, the utensils are simple in construction, inexpensive, attractive and functional. Preferably such utensils are formed of a strong, yet lightweight and somewhat flexible material, such as plastic. Accordingly, they are sturdy enough to stir viscous foods, such as yogurt, scrape frozen foods, such as ice cream, or stab or pierce food, such as cole slaw, but flexible enough to fit releasably and neatly within the container's lid.

Without further elaboration the foregoing will so fully illustrate my invention that others may by applying current or future knowledge readily adapt the same for use under various conditions of service.

What is claimed as the invention is:

1. In combination, a utensil and a lid for sealing a container, said container being arranged for holding a product therein and having a circular mouth for access to the contents of said container, said mouth including a circular rim disposed thereabout, said lid comprising a central portion and annular wall means projecting at an angle to the central portion, said wall means encircling the periphery of the central portion and being arranged to cooperate with the rim of the container to secure said lid to said container, said wall means comprising an inner circular wall and an outer circular wall projecting downward from said central portion and defining an annular recess therebetween for receipt of said rim, said inner wall having an annular free edge surface which projects slightly inward radially, said inner wall and said central portion defining a circular central recess therebetween and having an entrance which is smaller in diameter than said central recess, said utensil being formed of a thin, strong, yet relatively flexible plastic and comprising an elongated linear body slightly bowed in cross section along its length to provide longitudinal rigidity and to enable at least two similarly constructed utensils to nest together within said central recess at any diametric angular orientation therein, said utensil body having a pair of opposed arcuate ends, each having a radius of curvature approximately equal to the radius of curvature of said central recess with the maximum length of said utensil body measured between said arcuate ends being approximately the same size as the diameter of the central recess, whereby said utensil is frictionally held within said recess between opposed portions of said inner wall yet can be readily removed therefrom for use on the contents of said container without affecting the ability of the lid to seal said container.

2. The combination of claim 1 wherein one of the ends of said utensil includes plural tines to form a fork.

3. The combination of claim 1 wherein one of the arcuate ends of said utensil is serrated to form a knife.

4. The combination of claim 1 wherein said utensil includes transversely extending barrier means located at a midportion along the length of said utensil and a planar lip at one of the arcuate ends of said utensil to form a bowl therebetween for use as a measuring spoon.

* * * * *